US009089203B1

(12) United States Patent
Al-Raqadi et al.

(10) Patent No.: US 9,089,203 B1
(45) Date of Patent: Jul. 28, 2015

(54) DESK EXTENSION

(71) Applicant: SULTAN QABOOS UNIVERSITY, Muscat (OM)

(72) Inventors: Muadh Khalfan Al-Raqadi, Al-Khodh (OM); Waleed Sarhan Hamad Al Saidi, Al Khodh (OM)

(73) Assignee: SULTAN QABOOS UNIVERSITY, Muscat (OM)

( * ) Notice: Subject to any disclaimer, the term of this patent is extended or adjusted under 35 U.S.C. 154(b) by 0 days.

(21) Appl. No.: 14/537,854

(22) Filed: Nov. 10, 2014

(51) Int. Cl.

| | |
|---|---|
| ***A47B 57/00*** | (2006.01) |
| ***A47B 1/04*** | (2006.01) |
| ***A47B 97/00*** | (2006.01) |
| *A47B 23/04* | (2006.01) |
| *A47B 23/02* | (2006.01) |
| *A47B 17/03* | (2006.01) |

(52) U.S. Cl.
CPC . *A47B 1/04* (2013.01); *A47B 97/00* (2013.01); *A47B 17/036* (2013.01); *A47B 23/02* (2013.01); *A47B 23/043* (2013.01)

(58) Field of Classification Search
CPC .... A47B 21/0314; A47B 13/14; A47B 17/03; A47B 17/036; A47B 23/042; A47B 23/043; A47B 23/044; D06F 81/003
USPC ..... 108/25, 42, 91, 92, 93, 94, 97, 98, 152, 108/62, 63, 134, 135; 248/447, 447.2, 454, 248/455, 456, 457; 312/140.4
See application file for complete search history.

(56) References Cited

U.S. PATENT DOCUMENTS

| | | | | |
|---|---|---|---|---|
| 2,201,598 | A * | 5/1940 | Towler | 108/135 |
| 2,449,492 | A * | 9/1948 | Long | 248/454 |
| 4,373,639 | A | 2/1983 | Tricon | |
| 5,081,936 | A * | 1/1992 | Drieling | 108/43 |
| 5,248,192 | A | 9/1993 | Tazzia | |
| 5,317,977 | A | 6/1994 | Omessi | |
| 5,590,607 | A * | 1/1997 | Howard | 108/98 |
| 5,598,786 | A | 2/1997 | Patterson | |
| 6,234,085 | B1 | 5/2001 | Ramundo | |
| 6,527,235 | B1 | 3/2003 | Cotterill | |
| 7,536,960 | B1 | 5/2009 | Perez et al. | |
| 7,823,520 | B2 * | 11/2010 | Mayben | 108/129 |
| 7,922,191 | B2 | 4/2011 | Choi | |
| D686,630 | S | 7/2013 | Ehrlich | |
| 8,985,033 | B1 * | 3/2015 | Whitlock | 108/152 |
| 2002/0171271 | A1 | 11/2002 | Jennings | |
| 2006/0162625 | A1 * | 7/2006 | Mayben | 108/97 |
| 2010/0192811 | A1 | 8/2010 | Khalil | |
| 2010/0294909 | A1 * | 11/2010 | Hauser et al. | 248/456 |
| 2011/0056412 | A1 | 3/2011 | Grammer et al. | |
| 2013/0134744 | A1 | 5/2013 | Dehli | |

* cited by examiner

*Primary Examiner* — Daniel J Troy
*Assistant Examiner* — Andres F Gallego
(74) *Attorney, Agent, or Firm* — Richard C Litman

(57) ABSTRACT

The desk extension is quickly and conveniently attached and removed from the edge of a desk or table to provide additional surface area for the user. The desk extension has two parallel panels or levels when deployed to maximize the available area. The two panels are held parallel to one another when deployed, and one panel folds into a recess in the bottom of the other panel for storage when not in use. A clamp mechanism includes two folding clamps that are pivoted beneath the upper plate of the clamp assembly for compact storage when not in use. The clamp mechanism is pivotally attached to the edges of the lower panel to position the two panels horizontally when the extension is attached to a sloped surface, or to position the two panels at an oblique angle, if desired.

15 Claims, 8 Drawing Sheets

DESK EXTENSION

BACKGROUND OF THE INVENTION

1. Field of the Invention

The present invention relates generally to furniture and furnishings, and particularly to a folding desk extension for removable attachment to the edge of a desk, table, or the like.

2. Description of the Related Art

The typical academic classroom desk is relatively small and provides barely sufficient room for an open book and a standard sheet of writing paper. The typically small area provided by the average academic desk surface may be due to various factors, such as the need to economize on space to maximize the number of desks and students in a classroom, the desire of school officials to economize by minimizing the size and corresponding cost of classroom desks, and other factors. In any event, the surface area of the desk is often minimal for the needs of the student.

As schools and students have increasingly accepted the use of personal computers, much of the limited desktop space available is often taken up by a laptop computer and keyboard, leaving little or no space for books, note paper, and other essential tools and equipment. In many cases additional room is required for manipulating a computer mouse when the computer is not equipped with a touch screen or track ball. The typical academic classroom student desk severely limits the activities of the student occupying the desk. The distractions of maneuvering and manipulating different articles to provide room for the specific article needed at the immediate time (book, note paper, computer, etc.) may draw attention away from the learning experience.

Thus, a desk extension solving the aforementioned problems is desired.

SUMMARY OF THE INVENTION

The desk extension includes two separate rigid panels or levels that are connected to one another by rigid parallel arms. One of the panels nests within the bottom of the other panel when the extension is folded for storage. The two panels are held parallel to one another with one above the other when deployed for use. The upper panel may include various compartments or recesses adapted for use as a cup holder, pen and pencil grooves or trays, and/or other purposes.

The lower panel includes a desk clamp mechanism extending therefrom. The desk clamp mechanism is pivotally attached to opposite edges of the lower panel. The angle between the lower panel and the desk clamp is adjustable and lockable to secure the two panels at any desired angle when the device is secured to a sloped desk or other surface. The desk clamp mechanism includes a pair of folding clamps that can be pivoted to lie flat beneath the upper surface of the desk clamp mechanism for compact storage when not in use. The clamps and clamping mechanism are configured to facilitate their rapid installation and removal to and from a desk in order to minimize the time required at the beginning and end of a classroom period.

The two panels of the desk extension serve to maximize the available amount of combined surface area of the desk to which the desk extension is attached and the desk extension itself, while minimizing the horizontal area required for the combination. The panels of the desk extension are preferably formed of plastic to minimize weight. The folded device is both lightweight and compact for convenient storage in a book bag or the like when not in use.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The desk extension comprises a compact means of providing additional horizontal, or substantially horizontal, surface area for a desk, table, or the like, without a corresponding increase of the total subtended area. This is due to the two separate surfaces overlying each other when the desk extension is deployed for use. It should be noted that while the device is titled "desk extension," it may be attached to or used a variety of furniture articles or furnishings, e.g., tables, desks, drafting boards, work stations, shelves, etc.

Figure 1:
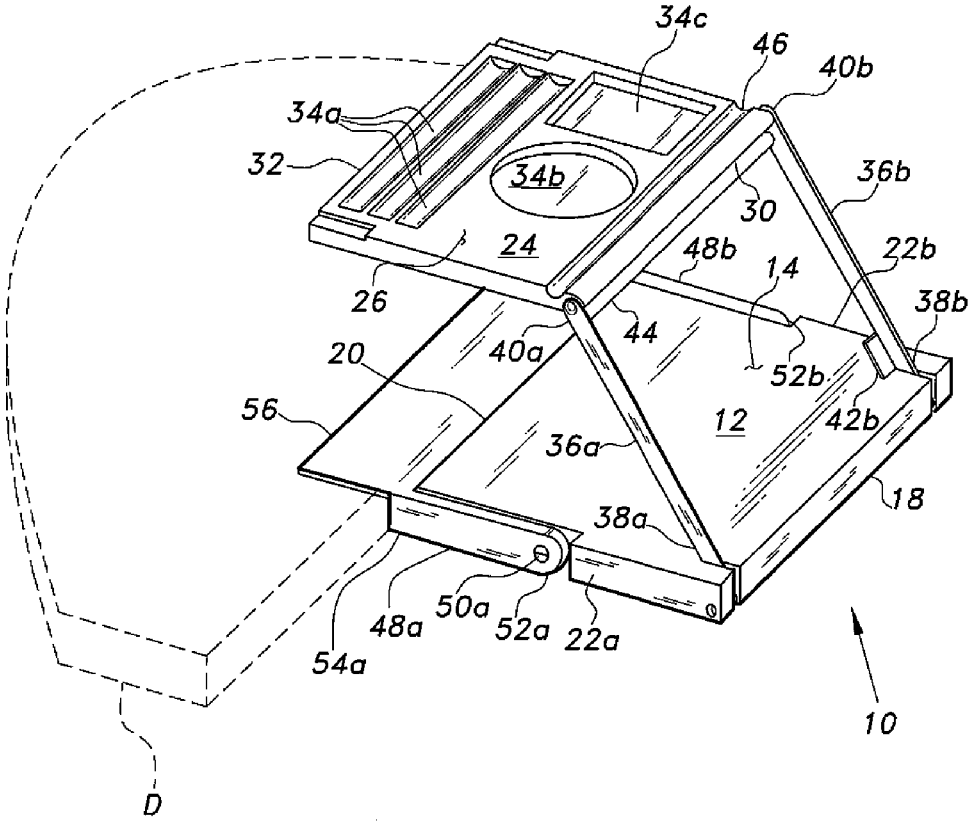
FIG. 1 is a perspective view of a desk extension according to the present invention as viewed from above the device, illustrating its basic features.
Figure 2:
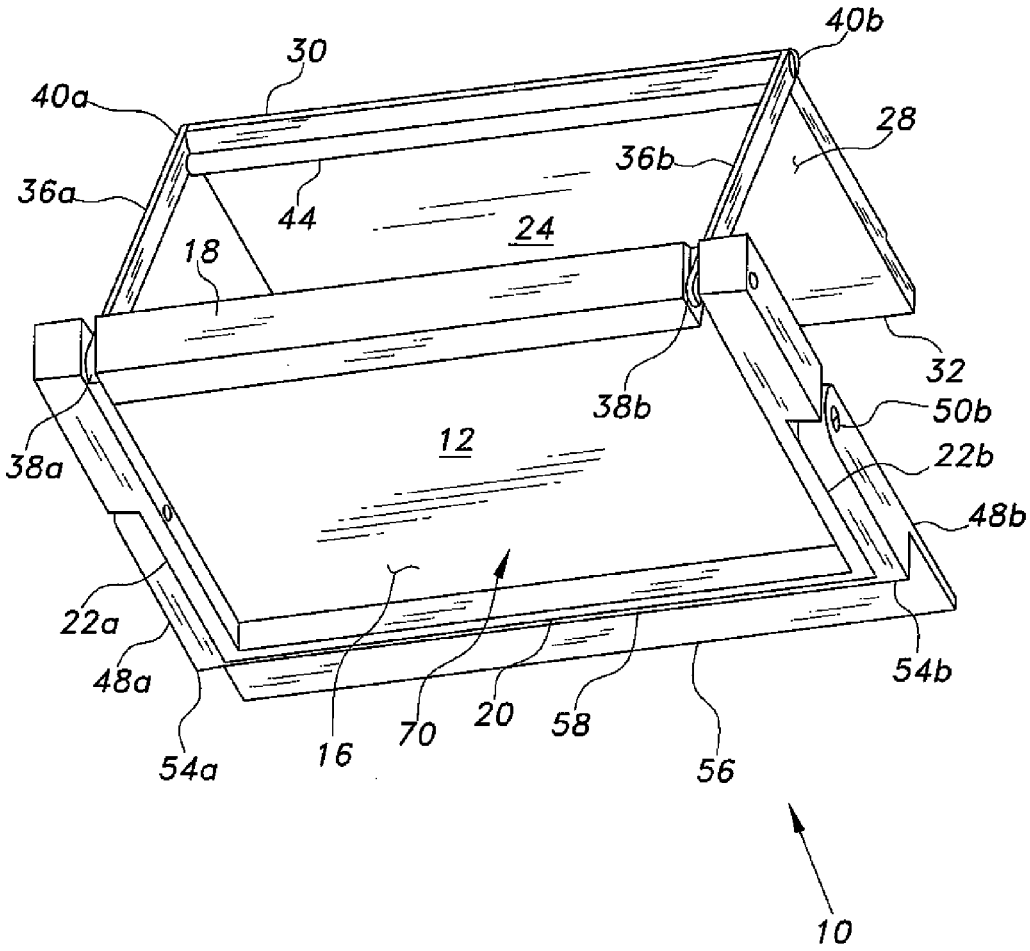
FIG. 2 is a perspective view of the desk extension of FIG. 1 in the same configuration, but viewed from below, illustrating further features thereof.

FIG. 1 provides a top perspective view of the desk extension 10 in its deployed state as it would be removably attached to the edge of a desk D, the desk D being shown in broken lines. The desk extension 10 includes a base or first panel 12 having a first surface 14, i.e., the upper surface when deployed, an opposite second or lower surface 16 (shown in FIG. 2), a linkage attachment edge 18, a clamp extension edge 20, and mutually opposed first and second lateral edges 22*a* and 22*b* extending between the linkage attachment edge 18 and the clamp extension edge 20.

A second or upper panel 24 is disposed above the base or first panel 12 when the desk extension is deployed for use as shown in FIG. 1. The second panel 24 includes a first surface 26, i.e., the upper surface when deployed for use, a second surface 28 opposite the first surface (shown in FIG. 2), a linkage attachment edge 30, and a free edge 32 opposite the linkage attachment edge 30. The first or upper surface 26 preferably includes a plurality of article holder recesses defined therein, e.g., one or more pencil or pen holder grooves 34*a*, a cup holder 34*b*, a mouse or other implement holder 34*c*, etc. These various article holder recesses 34*a* through 34*c* may be used to temporarily hold the above-mentioned articles, and/or any other suitable articles. Both the second or upper panel 24 and the base or first panel 12 are preferably formed of plastic, but other materials may be used alternatively.

A linkage comprising parallel first and second arms 36*a* and 36*b* connects the two panels 12 and 24 to one another. Each arm 36*a*, 36*b* has a base panel end 38*a*, 38*b* pivotally attached to the linkage attachment edge 18 of the first or lower panel 12, and an opposite upper or second panel end 40*a*, 40*b* pivotally attached to the linkage attachment edge 30 of the second or upper panel 24.

Each of the linkage arms 36*a*, 36*b* includes a base or first panel limit stop comprising a stop or limit tab 42*a*, 42*b* (shown in FIGS. 3 and 8), extending therefrom adjacent to the respective base or first panel end 38*a*, 38*b* of the arm. The tabs 42*a*, 42*b* contact the first or upper surface 14 of the first or base panel 12 when the two linkage arms 36*a*, 36*b* are cantilevered to about a 60° angle relative to the first or base panel 12 to prevent the two linkage arms 36*a*, 36*b* from rotating or pivoting to a more acute angle relative to the base panel 12. The limiting angle, e.g., 60°, may be adjusted according to the locations of the two stop or limit tabs 42*a*, 42*b*.

Figure 3:
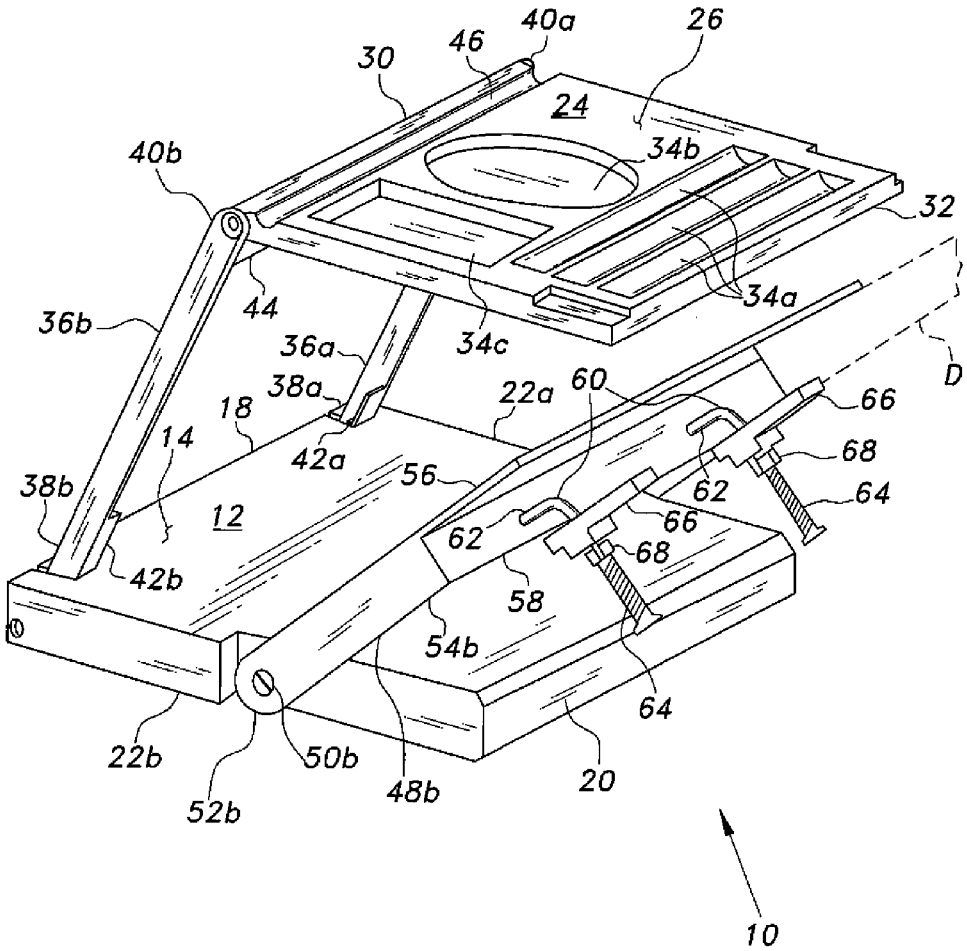
FIG. 3 is a perspective view of the desk extension of FIG. 1, shown with the desk clamp portion of the device pivoted upward.
Figure 7:
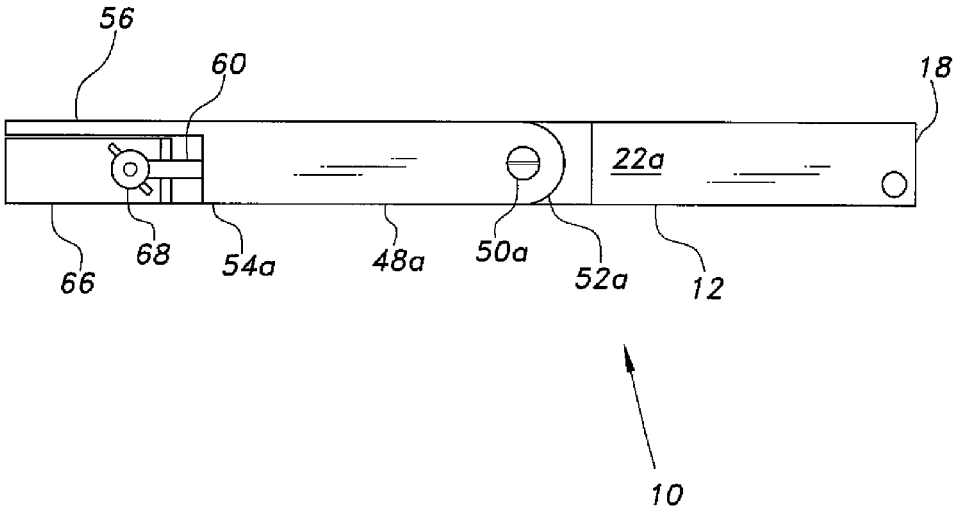
FIG. 7 is a side elevation view of the desk extension of FIG. 1, showing the desk extension in its completely folded state.
Figure 8:
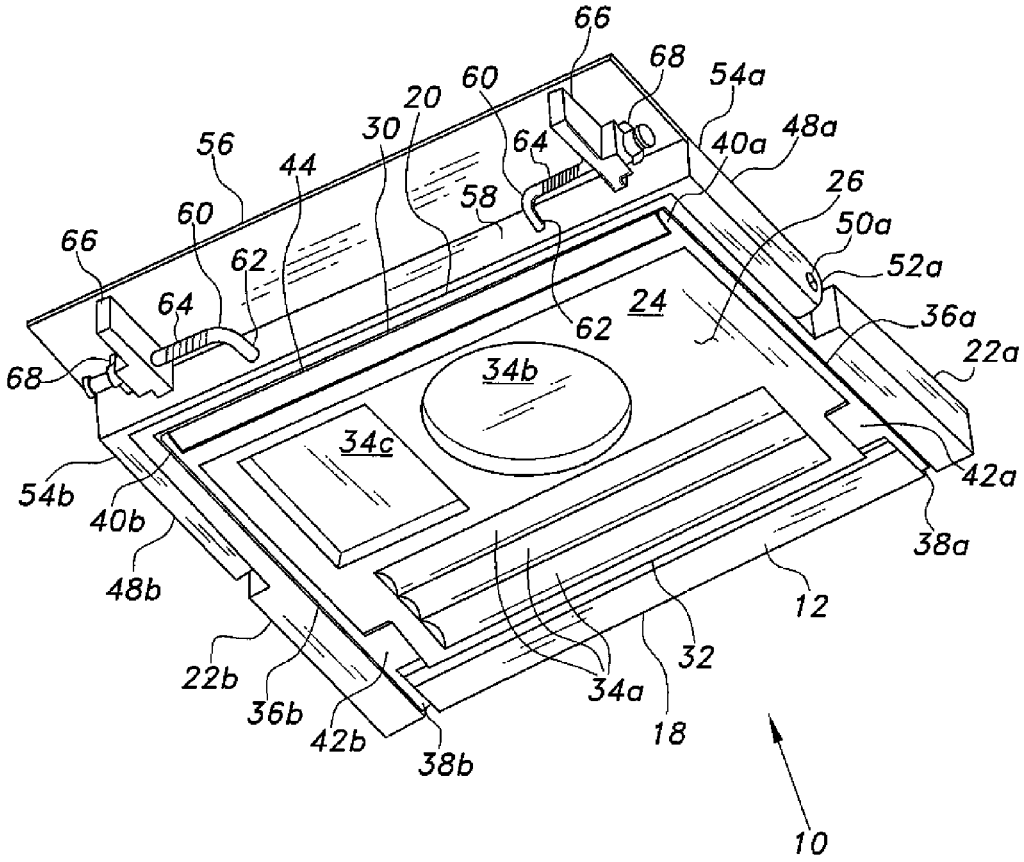
FIG. 8 is a perspective view of the desk extension of FIG. 1 as seen from below, showing the desk extension in its completely folded state.

Angular limitation of the second or upper panel 24 relative to the two linkage arms 36*a*, 36*b* is provided by a second panel limit stop comprising a bar 44 that extends between the two arms 36*a*, 36*b* adjacent their second panel ends 40*a*, 40*b*. The second or lower surface 28 of the second or upper panel 24 adjacent its linkage attachment edge 30 engages or rests upon the stop limit bar 44 when the second or upper panel 24 is fully deployed. The exact location or position of the stop limit bar 44 is set to stop the rotation of the second or upper panel 24 between the linkage arms 36*a*, 36*b* so that it extends parallel to the lower or first panel 12 when the desk extension 10 is fully opened or deployed, as shown in FIGS. 1 through 4. In other words, when the desk extension 10 is fully deployed for use, the angle between the lower or base panel 12 and the linkage arms 36*a*, 36*b* and the angle between the second or upper panel 24 and the linkage arms 36*a*, 36*b* add up to 180°. As shown in FIG. 3, a clearance groove or channel 46 is formed laterally across the upper or first surface 26 of the upper or second panel 24. The stop limit bar 44 nests in the clearance groove or channel 46 when the upper or second panel 24 is rotated to lie between the two linkage arms 36*a*, 36*b* when the desk extension 10 is folded for storage, as shown in FIGS. 7 and 8 and described further below. It will be seen in FIGS. 1, 3, and 4 that the clearance groove or channel 46 may also serve as an additional pencil or pen holder or the like when the desk extension 10 is fully deployed.

FIGS. 3 through 8 show a desk clamp assembly that extends from the first or base panel 12. The desk clamp assembly serves to secure the desk extension 10 temporarily and removably to the edge of a desk D or other suitable surface or structure. The desk clamp assembly comprises parallel first and second clamp arms 48*a*, 48*b* extending from first and second clamp arm locks 50*a* and 50*b* respectively disposed along the first and second lateral edges 22*a* and 22*b* of the first or base panel 12. The clamp arm locks 50*a*, 50*b* comprise screws or bolts about which the first panel attachment ends 52*a* and 52*b* rotate or pivot for deployment and folding. The screws or bolts may be tightened or loosened to lock the orientation of the two clamp arms 48*a*, 48*b* at a predetermined angle relative to the first or base panel 12, or to allow them to pivot or rotate as desired. Each of the clamp arms 48*a*, 48*b* has a distal end 54*a*, 54*b*, and a desk attachment plate 56 extending thereacross. The two parallel clamp arms 48*a*, 48*b* define a plane. The desk attachment plate 56 lies parallel to the plane of the clamp arms 48*a*, 48*b*, as shown in the various drawing Figures. A clamp attachment plate 58 extends from the desk attachment plate 56, normal to both the desk attachment plate 56 and the two clamp arms 48*a* and 48*b*.

At least one clamp, and preferably two clamps pivotally extend from the clamp attachment plate 58. Each clamp comprises an elongate bolt 60 having a base portion 62 that extends pivotally from the clamp attachment plate 58 normal thereto, and a threaded clamp portion 64 normal to the base portion 62. Thus, each clamp bolt 60 has a substantially L-shaped configuration. An elongate clamp finger 66 is slidably disposed upon the threaded portion 64 of the clamp bolt 60 so that the elongate extension of the clamp finger 66 is disposed parallel to the plane of the desk attachment plate 56 when the threaded clamp portion 64 of the clamp bolt 60 is pivoted normal to the desk attachment plate 56, as shown in FIGS. 3 through 6 of the drawings. An adjustably threaded fastener 68, e.g., a wing nut or other easily manipulated device, is disposed upon the threaded clamp portion 64 of the clamp bolt 60. The fastener 68 may be threaded along the clamp portion 64 of the bolt 60 in order to advance the clamp finger 66 to clamp the edge of a desk D or other surface between the desk attachment plate 56 and the clamp finger 66, or to loosen the clamp finger 66 to allow the desk extension 10 to be removed from the desk D or other surface. The pivotal attachment of the base portion 62 of the clamp bolt 60 allows the clamp assembly to be pivoted parallel to the desk attachment plate 56 for compact storage, as shown in FIGS. 7 and 8.

In order to attach the desk extension 10 to the edge of a desk D or other suitable surface, the clamp bolts 60 are pivoted so that their threaded portions 64 are substantially normal to the plane of the desk attachment plate 56, and the device is placed upon the edge of the desk D with the desk attachment plate 56 adjacent to the upper surface of the desk D and the clamp fingers 66 below the edge of the desk D. The fasteners 68 are then tightened to clamp the edge of the desk D between the desk attachment plate 56 and the clamp fingers 66. Removal of the desk extension 10 is accomplished by reversing the above procedure.

Figure 4:
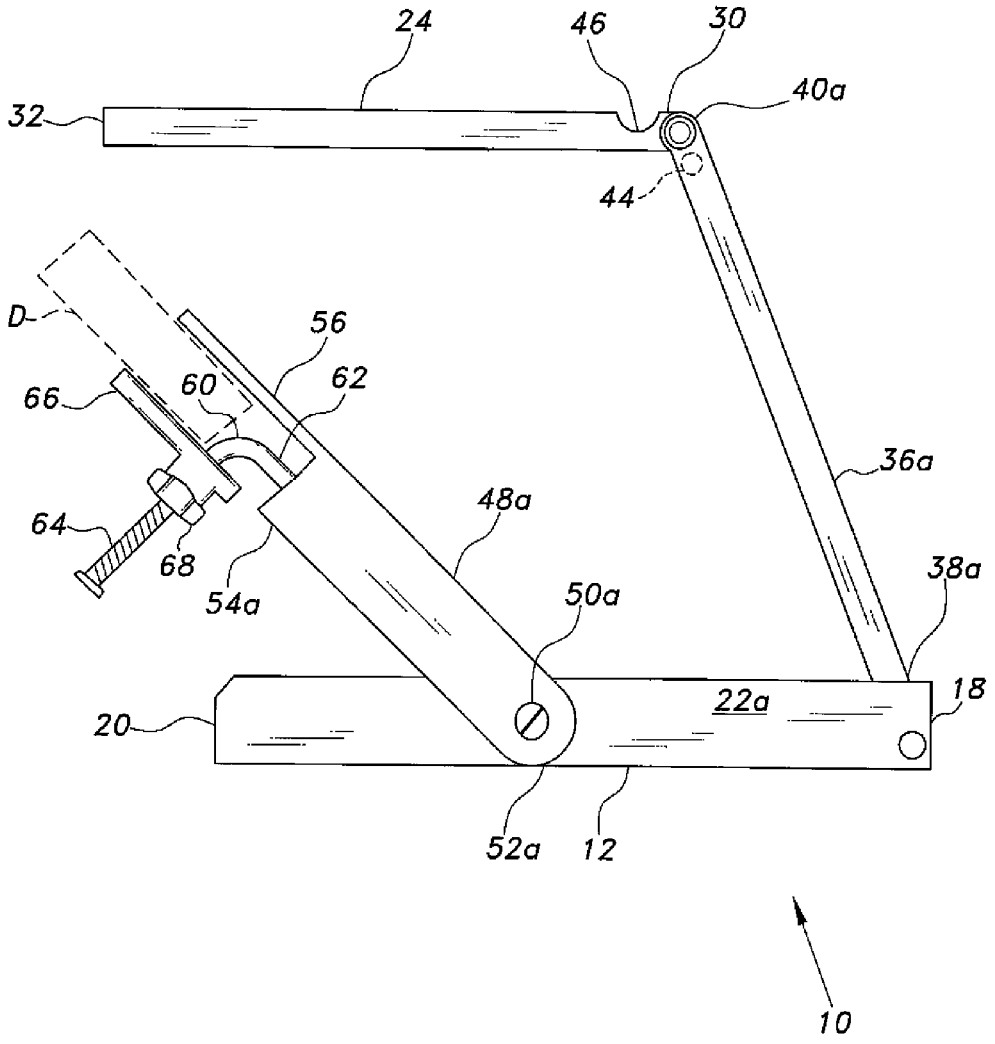
FIG. 4 is a side elevation view of the desk extension of FIG. 1, illustrating further details of the desk clamp mechanism.
Figure 5:
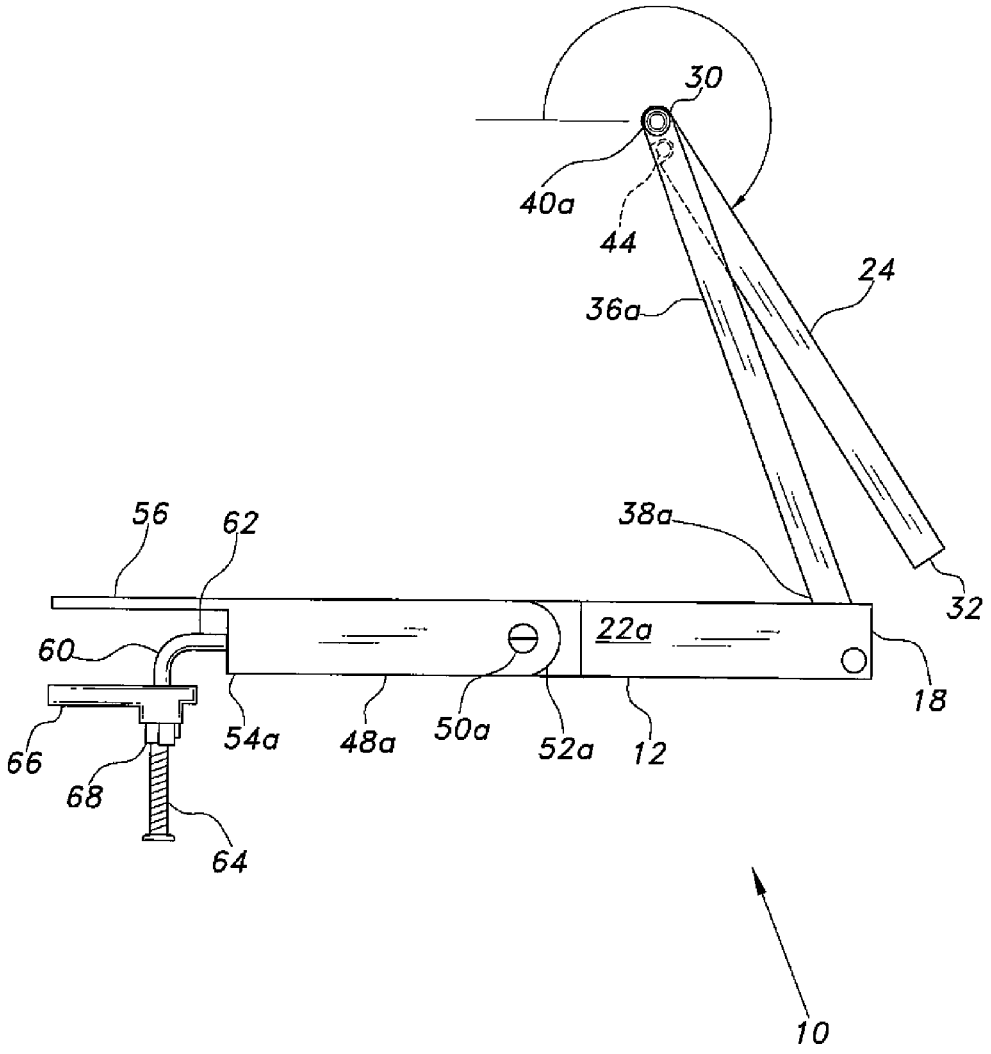
FIG. 5 is a side elevation view of the desk extension of FIG. 1, illustrating an initial step in the process of folding the device.
Figure 6:
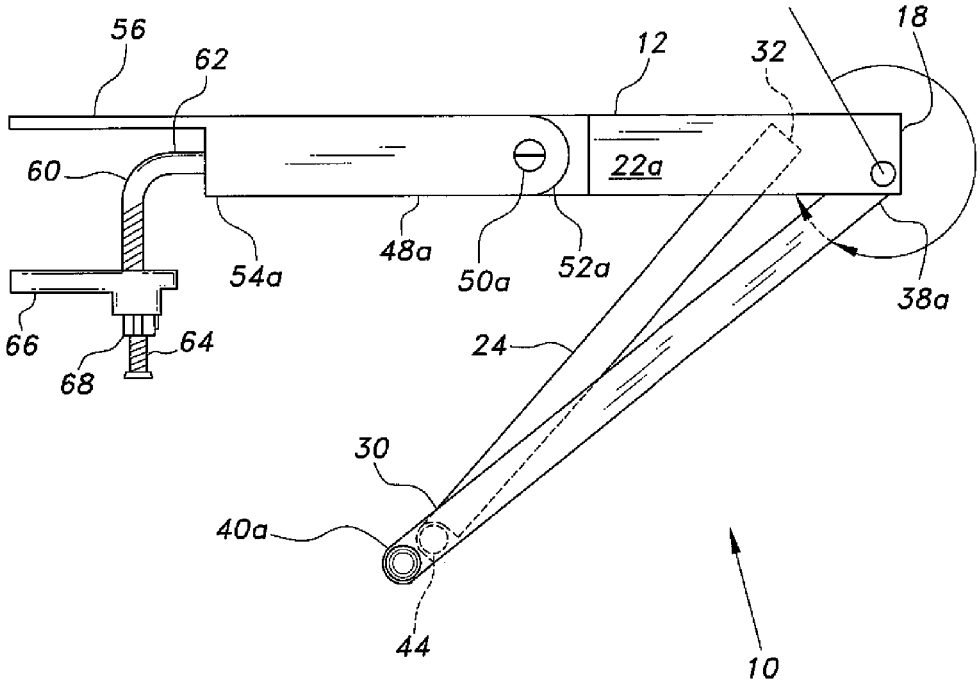
FIG. 6 is a side elevation view of the desk extension of FIG. 1, illustrating a further step in the process of folding the device.

FIG. 4 provides a side elevation view of the deployed desk extension 10 ready for use. FIGS. 5 and 6 show intermediate orientations of the two panels 12 and 24 and the linkage arms, e.g., arm 36*a*, during the folding process. FIGS. 7 and 8 illustrate the desk extension 10 in its completely folded state. (It should be noted that FIGS. 3 and 4 show an alternative adjustment of the desk extension 10, in which the clamp arms 48*a* and 48*b* are at an oblique angle to the plane of the base or first panel 12 in order to secure the desk extension 10 to a non-horizontal desk D, while orienting the two panels 12 and 24 substantially horizontally.) In FIG. 4, the two panels 12 and 24 of the desk extension 10 are fully deployed parallel to one another and spaced apart from one another, i.e., non-coplanar, by the linkage arms, e.g., arm 36*a* shown in the side elevation view of FIG. 4.

In FIG. 5, the linkage arms remain at their fully deployed angle relative to the first or base panel 12, as shown by the linkage arm 36*a* in FIG. 5. However, the second or upper panel 24 has been rotated clockwise about its pivotal attachment to the upper or second panel ends of the linkage arms, as shown by the end 40*a* of the linkage arm 36*a* in FIG. 5. The rotation of the second panel 24 relative to the linkage arms subtends an angle of about 230° in FIG. 5, leaving about another 10° remaining to position the second panel 24 between and parallel to the two linkage arms 36*a*, 36*b*. It will be seen that if the second panel 24 were rotated to lie parallel to and between the two linkage arms, 36*a*, 36*b*, its rotation from its fully deployed horizontal position would be about 240° due to the approximately 60° angle between the lower or base panel 12 and the linkage arms.

In FIG. 6, the second panel 24 retains its rotation of about 230° relative to the two linkage arms 36*a*, 36*b*, the first linkage arm 36*a* being shown in FIG. 6. However, the linkage arms 36*a*, 36*b* have also been rotated about 260° clockwise relative to the first or base panel 12. About another 60° degrees remain in order to position the linkage arms 36*a*, 36*b* parallel to the base panel 12.

FIGS. 7 and 8 illustrate the desk extension 10 in its completely folded state. In FIG. 7, the second or upper panel 24 has been rotated to lie between the two linkage arms, i.e., a clockwise angular rotation of substantially 240° from its deployed state cantilevered from the two extension arms 36*a*, 36*b* as shown in FIGS. 1 through 4. In addition, the two linkage arms 36*a*, 36*b* have been rotated to lie parallel to the first or base panel 12, i.e., a clockwise rotation of substantially 300° from their fully deployed state, as shown in FIGS. 1 through 4. It will be seen that the second or upper panel 24 rotates through a total are of substantially 540° degrees, or one and a half revolutions, from its deployed state cantilevered from the two linkage arms 36*a*, 36*b* to its folded state, as shown in FIGS. 7 and 8. The first surface 26 of the second panel 24 is thus inverted from its orientation when deployed for use, as will be seen in the bottom perspective view of the folded desk extension 10, shown in FIG. 8.

Returning to FIG. 2, it will be noted that there is a receptacle 70 in the bottom or underside of the lower or first panel 12 for the storage of the second panel 24 therein. This second panel storage receptacle 70 provides for the nesting of the second panel 24 within the receptacle 70 and between the two linkage arms 36*a*, 36*b* and the two sides or edges 22*a*, 22*b* of the first panel 12 when the second panel 24 is in its stored state, as shown in FIGS. 7 and 8. Thus, the thickness of the entire device in its folded state is no greater than the thickness of the first panel 12. This enables the desk extension 10 to be carried easily in a book bag, briefcase, or other similar container without requiring excessive room or space, but permitting other articles (e.g., books, a laptop computer, etc.) to be carried in the container with the desk extension 10.

It is to be understood that the present invention is not limited to the embodiments described above, but encompasses any and all embodiments within the scope of the following claims.

We claim:

1. A desk extension, comprising:

a base panel having a first surface, a second surface opposite the first surface, a linkage attachment edge, and a clamp extension edge opposite the linkage attachment edge;

a desk clamp assembly extending from the base panel;

a linkage pivotally extending from the linkage attachment edge of the base panel, the linkage having a base panel end and a second panel end opposite the base panel end;

at least one base panel limit stop disposed upon the linkage, the base panel limit stop contacting the first surface of the base panel to limit angular rotation of the linkage when deployed;

a second panel pivotally extending from the second panel end of the linkage, the second panel having a first surface, a second surface opposite the first surface, and a linkage attachment edge;

at least one second panel limit stop disposed upon the second panel end of the linkage, the second panel limit stop contacting the linkage attachment edge of the second panel to limit angular rotation of the second panel when deployed, the base panel and the second panel being parallel to one another when the base panel limit stop engages the base panel and the second panel limit stop engages the second panel; wherein the base panel has opposed first and second lateral edges extending between the linkage attachment edge and the clamp extension edge; the desk clamp assembly comprises: first and second clamp arm locks disposed upon the first and second lateral edges of the base panel, respectively; first and second clamp arms pivotally extending from the first and second clamp arm locks, respectively, the clamp arm locks selectively locking the clamp arms at a predetermined angle relative to the base panel, each of the clamp arms having a distal end; a desk attachment plate extending across the distal ends of the clamp arms, the clamp arms defining a plane, the desk attachment plate being disposed in a plane parallel to the plane of the clamp arms; a clamp attachment plate extending orthogonally from the desk attachment plate; at least one clamp having: an elongate bolt having a base portion pivotally extending from the clamp attachment plate normal thereto, and a threaded clamp portion extending normal to the base portion; a clamp finger slidably disposed upon the clamp portion of the bolt, the clamp finger being disposed parallel to the desk attachment plate when the clamp portion of the bolt is pivoted normal to the desk attachment plate; and an adjustably threaded fastener disposed upon the clamp portion of the bolt, the fastener adjusting the clamp finger relative to the desk attachment plate, the clamp finger and bolt being selectively pivotal to a position parallel to the desk attachment plate for storage.

2. The desk extension according to claim 1, wherein the base panel has a second panel storage receptacle defined in the second surface thereof, the second panel selectively nesting in the second panel storage receptacle of the base panel.

3. The desk extension according to claim 2, wherein:

the second panel has a fully deployed state parallel to and non-coplanar with the base panel, and a stored state disposed within the second panel storage receptacle of the base panel;

the linkage is pivotal through an arc of substantially 300° between engagement of the base panel limit stop with the first surface of the base panel and a folded state parallel to the base panel; and the second panel is pivotal through an arc of substantially 240° between engagement of the second panel limit stop with the linkage attachment edge of the second panel and the stored state of the second panel, the second panel pivoting through a combined are of substantially 540° between the fully deployed state and the stored state thereof.

4. The desk extension according to claim 1, further comprising at least one article holder recess defined in the first surface of the second panel.

5. The desk extension according to claim 1, wherein the base panel and the second panel are formed of plastic.

6. A desk extension, comprising:

a base panel having a first surface, a second surface opposite the first surface, a linkage attachment edge, a clamp extension edge opposite the linkage attachment edge, and opposed first and second lateral edges extending between the linkage attachment edge and the clamp extension edge;

a desk clamp assembly having:

first and second clamp arm locks disposed upon the first and second lateral edges of the base panel, respectively;

first and second clamp arms pivotally extending from the first and second clamp arm locks, respectively, the clamp arm locks selectively locking the clamp arms at a predetermined angle relative to the base panel, each of the clamp arms having a distal end;

a linkage pivotally extending from the linkage attachment edge of the base panel, the linkage having a base panel end and a second panel end opposite the base panel end;

a second panel pivotally extending from the second panel end of the linkage, the second panel having a first surface, a second surface opposite the first surface, and a linkage attachment edge; a desk attachment plate extending across the distal ends of the clamp arms, the clamp arms defining a plane, the desk attachment plate being disposed in a plane parallel to the plane of the clamp arms; a clamp attachment plate extending orthogonally from the desk attachment plate; at least one clamp having: an elongate bolt having a base portion pivotally extending from the clamp attachment plate normal thereto, and a threaded clamp portion normal to the base portion; a clamp finger slidably disposed upon the clamp portion of the bolt, the clamp finger being disposed parallel to the desk attachment plate when the clamp portion of the bolt is pivoted normal to the desk attachment plate; and an adjustably threaded fastener disposed upon the clamp portion of the bolt, the fastener adjusting the clamp finger relative to the desk attachment plate, the clamp finger and bolt being selectively pivotal parallel to the desk attachment plate for storage.

7. The desk extension according to claim 6, further comprising:

at least one base panel limit stop disposed upon the linkage, the base panel limit stop contacting the first surface of the base panel to limit angular rotation of the linkage when deployed; and at least one second panel limit stop disposed upon the second panel end of the linkage, the second panel limit stop contacting the linkage attachment edge of the second panel to limit angular rotation of the second panel when deployed, the base panel and the second panel being parallel to one another when the base panel limit stop engages the base panel and the second panel limit stop engages the second panel.

8. The desk extension according to claim 7, wherein:

the base panel has a second panel storage receptacle defined in the second surface thereof, the second panel selectively nesting in the second panel storage receptacle of the base panel;

the second panel has a fully deployed state parallel to and non-coplanar with the base panel, and a stored state disposed within the second panel storage receptacle of the base panel;

the linkage is pivotal through an arc of substantially 300° between engagement of the base panel limit stop with the first surface of the base panel and a folded state parallel to the base panel; and the second panel is pivotal through an arc of substantially 240° between engagement of the second panel limit stop with the linkage attachment edge of the second panel and the stored state of the second panel, the second panel being pivotal through a combined are of substantially 540° between the fully deployed state and the stored state thereof.

9. The desk extension according to claim 6, further comprising at least one article holder recess defined in the first surface of the second panel.

10. The desk extension according to claim 6, wherein the base panel and the second panel are formed of plastic.

11. A desk extension, comprising:

a base panel having a first surface, a second surface opposite the first surface, a linkage attachment edge, and a clamp extension edge opposite the linkage attachment edge;

a desk clamp assembly extending from the base panel;

a linkage pivotally extending from the linkage attachment edge of the base panel, the linkage having a base panel end and a second panel end opposite the base panel end;

a second panel pivotally extending from the second panel end of the linkage, the second panel having a first surface, a second surface opposite the first surface, and a linkage attachment edge, the base panel having a second panel storage receptacle defined in the second surface thereof, the second panel selectively nesting in the second panel storage receptacle of the base panel; wherein the base panel has opposed first and second lateral edges extending between the linkage attachment edge and the clamp extension edge; the desk clamp assembly has: first and second clamp arm locks disposed upon the first and second lateral edges of the base panel, respectively; first and second clamp arms pivotally extending from the first and second clamp arm locks, the clamp arm locks selectively locking the clamp arms at a predetermined angle relative to the base panel, each of the clamp arms having a distal end; a desk attachment plate extending across the distal ends of the clamp arms, the clamp arms defining a plane, the desk attachment plate being disposed in a plane parallel to the plane of the clamp arms; a clamp attachment plate extending from the desk attachment plate normal thereto; at least one clamp, having: an elongate bolt having a base portion pivotally extending from the clamp attachment plate normal thereto, and a threaded clamp portion normal to the base portion; a clamp finger slidably disposed upon the clamp portion of the bolt, the clamp finger being disposed parallel to the desk attachment plate when the clamp portion of the bolt is pivoted normal to the desk attachment plate; and an adjustably threaded fastener disposed upon the clamp portion of the bolt, the fastener adjusting the clamp finger relative to the desk attachment plate, the clamp finger and bolt being selectively pivotal parallel to the desk attachment plate for storage.

12. The desk extension according to claim 11, further comprising:

at least one base panel limit stop disposed upon the linkage, the base panel limit stop contacting the first surface of the base panel to limit angular rotation of the linkage when deployed; and at least one second panel limit stop disposed upon the second panel end of the linkage, the second panel limit stop contacting the linkage attachment edge of the second panel to limit angular rotation of the second panel when deployed, the base panel and the second panel being parallel to one another when the base panel limit stop engages the base panel and the second panel limit stop engages the second panel.

13. The desk extension according to claim 12, wherein:

the second panel has a fully deployed state parallel to and non-coplanar with the base panel, and a stored state disposed within the second panel storage receptacle of the base panel;

the linkage is pivotal through an arc of substantially 300° between engagement of the base panel limit stop with the first surface of the base panel and a folded state parallel to the base panel; and the second panel is pivotal through an arc of substantially 240° between engagement of the second panel limit stop with the linkage attachment edge of the second panel and the stored state of the second panel, the second panel being pivotal through a combined are of substantially 540° between the fully deployed state and the stored state.

14. The desk extension according to claim 11, further comprising at least one article holder recess defined in the first surface of the second panel.

15. The desk extension according to claim 11, wherein the base panel and the second panel are formed of plastic.

* * * * *